United States Patent [19]

Yokoyama

[11] Patent Number: 4,599,795

[45] Date of Patent: Jul. 15, 1986

[54] CUTTING TOOL

[75] Inventor: Takashi Yokoyama, Mie, Japan

[73] Assignee: MCC Corporation, Mie, Japan

[21] Appl. No.: 618,825

[22] Filed: Jun. 8, 1984

[30] Foreign Application Priority Data

Jun. 11, 1983 [JP] Japan ..... 58-89194[U]
Jun. 11, 1983 [JP] Japan ..... 58-89195[U]
Jun. 11, 1983 [JP] Japan ..... 58-89196[U]

[51] Int. Cl.[4] ..... B26B 17/00

[52] U.S. Cl. ..... 30/188; 30/92; 30/192

[58] Field of Search ..... 30/188, 189, 190, 191, 30/192, 92, 94

[56] References Cited

U.S. PATENT DOCUMENTS 1,814,790 7/1931 Edwards .
1,915,404 6/1933 Clifton ..... 30/188 X
2,643,564 6/1953 Klein et al. ..... 30/188 X
3,210,844 10/1965 Tontscheff .
4,130,938 12/1978 Uhlmann ..... 30/192 X
4,176,450 12/1979 Muromoto ..... 30/92 X
4,178,682 12/1979 Sadauskas .
4,186,484 2/1980 Tanaka ..... 30/92 X
4,223,439 9/1980 Rommel .
4,312,127 1/1982 Tanaka ..... 30/92 X
4,378,636 4/1983 Wick ..... 30/92 X

FOREIGN PATENT DOCUMENTS 5620 of 1914 United Kingdom ..... 30/192

*Primary Examiner*—E. R. Kazenske
*Assistant Examiner*—William Fridie, Jr.
*Attorney, Agent, or Firm*—Wenderoth, Lind & Ponack

[57] ABSTRACT

A cutting tool of the ratchet operated type comprises several elements. A movable blade having a plurality of notches along the rear end thereof is moved relative to a stationary blade by an opening and closing operation of a pair of blades through a push bar which is in engagement with one of the notches. A pawl for preventing the return of the movable blade is elastically biased so as to be kept in a position disengaged from all of the notches under normal conditions. The pawl is brought into engagement with one of the notches by the push bar only when the pair of handles are fully closed relative to each other. Due to the above construction, the cutting tool according to the invention brings about reduced wear of the pawl and the notches and an easy cutting operation.

7 Claims, 7 Drawing Figures

CUTTING TOOL

FIELD OF THE INVENTION

The present invention relates to a cutting tool for cutting preferably metal wire, and more specifically to such a cutting tool a ratchet operated type.

DESCRIPTION OF THE PRIOR ART

There is known a cutting tool of the type comprising: a stationary blade and a movable blade positioned facing each other and both having teeth portions in mesh with each other, both the blades having cutting edge portions at the leading ends thereof so that the cutting edge portions face each other, the movable blade having a plurality of notches along the rear end thereof, the blades being pivoted to a common plate at points outward of the cutting edge portions; a pair of handles pivoted with each other to be opened or closed relative to each other for pivoting the movable blade relative to the stationary blade so that the cutting edge portions may be opened or closed relative to each other, one handle of the pair of handles being fixed to the rear end of the stationary blade; a pawl pivoted to one handle of the pair of handles to be engageable with one of the notches so as to prevent the return of the movable blade; a push bar pivoted to the other handle of the pair of handles, the push bar being provided with a projection for pushing up one of the notches when the pair of handles are moved toward each other.

This type of cutting tool allows a cutting operation to be performed by moving the pair of handles toward each other once or, if necessary, repeatedly. Namely, by the operation of the handles, one of the notches of the movable blade is pushed up by means of the push bar, which pivots the movable blade around the pivot axis relative to the stationary blade, thus moving the cutting edges which face each other toward a closed position for cutting a material therebetween.

This type of cutting tool of the prior art, however, has had the following problems:

(1) Since the pawl for preventing the return of the movable blade was always urged to engage with the notches, the pawl and the notches tended to cause wear when the notches were pushed up by the push bar.

(2) The pawl had to be disengaged from the notch manually before moving the movable blade away from the stationary blade, which was a dangerous operation.

(3) The need for manually operating the pawl made the operation of the tool complex.

SUMMARY OF THE INVENTION

Therefore, it is an object of the present invention to provide a cutting tool which enables the prevention of wear of the notches of the movable blade and the pawl that engages with the notches.

Another object of the present invention is to provide a cutting tool which does not need manual disengagement of the pawl from the notch.

A further object of the present invention is to provide a cutting tool which is easily operated.

These and other objects have been attained in a cutting tool comprising a stationary blade and a movable blade positioned facing each other and both having teeth portions in mesh with each other, both the blades having cutting edge portions at the leading ends thereof so that the cutting edge portions face each other, the movable blade having a plurality of notches along the rear end thereof, the blades being pivoted to a common plate at points outward of the cutting edge portions, a pair of handles pivoted with each other to be opened or closed relative to each other for pivoting the movable blade relative to the stationary blade so that the cutting edge portions may be opened or closed relative to each other, one handle of the pair of handles being fixed to the rear end of the stationary blade, a pawl pivoted to one handle of the pair of handles to be engageable with one of the notches so as to prevent the return of the movable blade, a push bar pivoted to the other handle of the pair of handles, the push bar being provided with a projection for pushing up one of the notches when the pair of handles are moved toward each other; by elastically biasing the pawl around the pivot axis thereof so as to keep it in a position disengaged from all of the notches under normal conditions and by providing the push bar with an elastically urging means to have the pawl engage with one of the notches by forcing the pawl to rotate against an elastically biased force when the pair of handles are fully closed relative to each other.

Since the present invention is constructed as described above, the cutting tool according to the present invention brings about the following effects:

(1) The wear of the pawl and notches is minimized since the pawl is kept in a position disengaged from the notches of the movable blade under normal conditions.

(2) The pawl does not need to be handled directly and manually since disengagement of the pawl from one of the notches before the movable blade is moved away from the stationary blade is accomplished by the operation of the pair of handles alone. This is helpful in avoiding the danger of injury.

(3) A series of cutting operations can be carried out easily since the opening and closing operation of the movable blade relative to the stationary blade can be performed by the operation of the pair of handles alone.

The above and other objects and attendant advantages of the present invention will be more readily apparent to those skilled in the art from a reading of the following detailed description in conjunction with the accompanying drawings which show one preferred embodiment for illustrating the invention only, but not for limiting the scope of the invention in any way.

DETAILED DESCRIPTION OF THE PREFERRED EMBODIMENT

Figure 1:
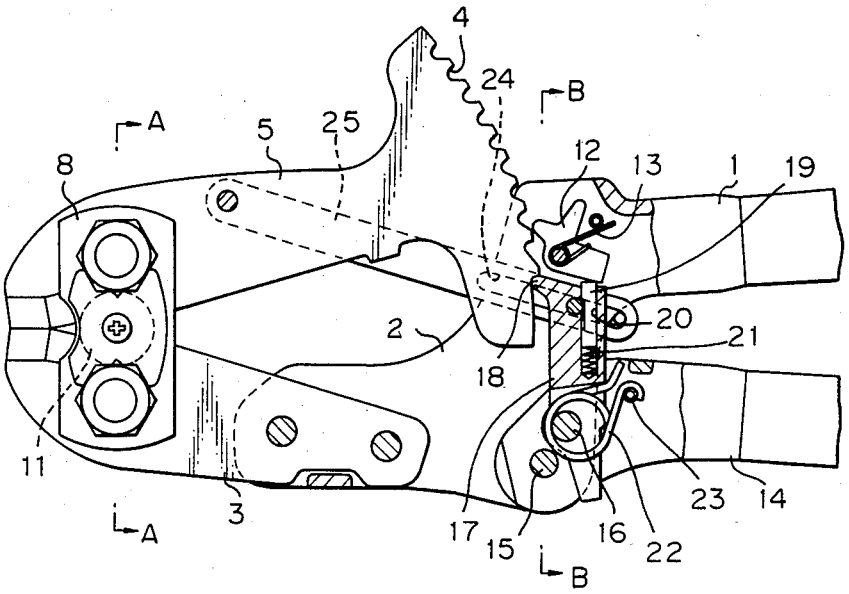
FIG. 1 is a front view of a bolt-clipper according to an embodiment of the present invention shown with a portion eliminated.
Figure 2:
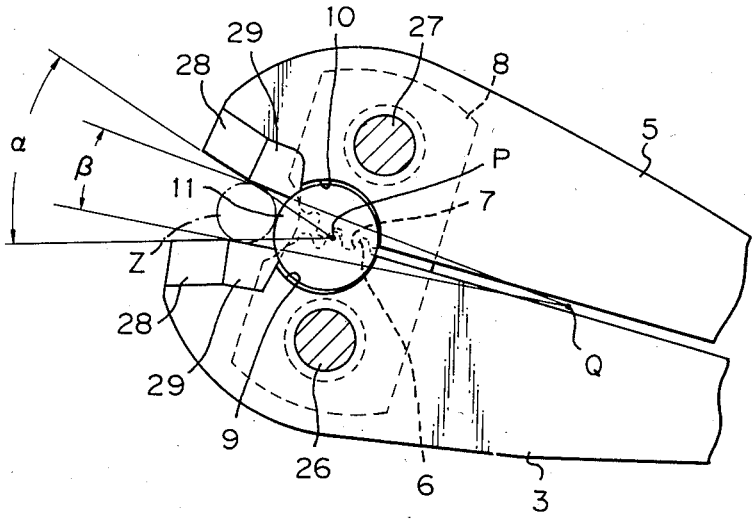
FIG. 2 is a front view showing the major portion of the movable blade and stationary blade of the bolt-clipper of FIG. 1 with the movable blade opened relative to the stationary blade.
Figure 3:
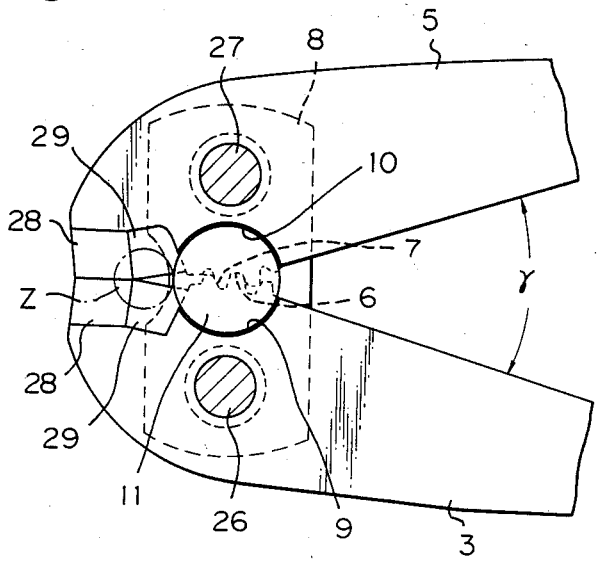
FIG. 3 is a front view showing the major portion of the movable blade and stationary blade of the bolt-clipper of FIG. 1 with the movable blade closed relative to the stationary blade.

The present invention will be explained hereinafter referring to a bolt-clipper shown in the attached drawings as an embodiment of the present invention. In FIG. 1, an upper handle 1 has a head portion 2 which has a space inside. A movable blade 5 and a stationary blade 3 are positioned facing each other, the movable blade 5 having a plurality of notches 4 along its rear end and the stationary blade 3 being fixed to the leading end of the upper handle 1. Each of the movable blade 5 and the stationary blade 3 has teeth 6, 7, respectively of generally spur gear configuration as shown in FIG. 2 and FIG. 3. Both blades 3 and 5 are pivoted to a plate 8 with the teeth 6 and 7 in mesh with each other. As described later in detail, the movable blade 5 moves or swings relative to the stationary blade 3 between a closed position shown in FIG. 3 and an opened position shown in FIG. 2 by the operation of the levers. The maximum swing angle $\gamma$ of the movable blade 5 is about 33° in this example. The cutting edge portions of both the movable blade 5 and stationary blade 3 consist of front cutting edge portions 28 and rear cutting edge portions 29. The front cutting edge portions 28 of the movable blade 5 and the stationary blade 3 and the rear cutting edge portions 29 of the movable blade 5 and the stationary blade 3 have different opening angles. The opening angle is defined as an angle formed between cutting edges of the movable blade 5 and the stationary blade 3 when the movable blade 5 is fully opened relative to the stationary blade 3, as shown in FIG. 2. The opening angle $\alpha$ of the front cutting edge portions 28 is equal to the maximum swing angle $\gamma$ of the movable blade 5 relative to the stationary blade 3. It is desirable that the opening angle 8 of the rear cutting edge portions 29 is below 15° and it is set at 12° in this example since an opening angle of more than 15° tends to cause a material which is to be cut to slip during the cutting operation. As shown in FIG. 2, the extended lines of front cutting edge portions 28 which have the opening angle $\alpha$ being equal to the maximum swing angle $\gamma$ have a point of intersection at P located on the meshed teeth portions 6 and 7. On the other hand, the extended lines of the rear cutting edge portions 29 which have the opening angle $\beta(\beta<\alpha)$ have a point of intersection at Q located to the rear of the meshed teeth portions 6 and 7.

Being constructed as described above, this tool has the following advantage if compared with a tool with straight edges which extend only along the lines starting from the point P having the opening angle $\alpha$. Namely, when the movable blade 5 is fully opened relative to the stationary blade 3 as shown in FIG. 2, the width of the space formed between the rear cutting edge portions 29, which extend along the lines starting from the point Q, is much greater than that formed between the rear cutting edge portions 29 of the straight edges which extend along the lines starting from the point P. Therefore, the cutting tool shown in the drawings can accept a material of larger diameter between the rear cutting edge portions 29 as compared with a cutting tool with straight edges as mentioned above. Since the opening angle of the rear cutting edge portions 29 is below 15° as described above, a material can be cut smoothly utilizing a large lever ratio without causing a slip along the cutting edges. And since the opening angle of the front edge portions is equal to the maximum swing angle $\gamma$ of the movable blade 5 relative to the stationary blade 3, the front edge portions 28 contact with each other along their full length when the movable blade 5 is fully closed relative to the stationary blade 3. Therefore, the front cutting edge portions 28 are useful for cutting completely a material of small diameter or a material half cut by the rear cutting edge portions 29. Although the lever ratio of the front cutting edge portions 28 is smaller than that of the rear cutting edge portions 29, the lever ratio is satisfactory for cutting a material of small diameter. The opening angle of the front cutting edge portions 28 is much greater than 15° as described above. However, since the actual cutting operation for a material of small diameter starts after the movable blade 5 is substantially closed relative to the stationary blade 3, the material can be cut smoothly without causing a slip along the front cutting edge portions 28.

On the same side of both the movable blade 5 and the stationary blade 3, a shallow semicircular recess is provided surrounding the teeth portions 6 and 7, respectively. These semicircular recesses form a generally round combined recess behind the plate 8. A round stopper 11 is fitted into this round recess so as to prevent the rearward movement during cutting operation of a material being cut along the rear cutting edge portions 29, as will be explained in detail later.

The diameter of the round stopper 11 is determined such that the position of the front end point of the round stopper 11 coincides with that of the front end point of the plate 8 under the condition shown in FIG. 3.

When the movable, blade 5 is opened relative to the stationary blade 3 as shown in FIG. 2, the teeth portions 6 and 7, being in mesh with each other, move forward. The round stopper 11 fitted into the round recess formed by the semicircular recesses 9, 10 on the movable blade 5 and stationary blade 3 moves forward also at the same time. A material Z to be cut is placed between the opened rear cutting edges 29. As the cutting operation is started, the movable blade 5 and the stationary blade 3 are pivoted relative to each other around bolts 27 and 26, respectively. The rear cutting edge portions 29 and the material Z also move toward the plate 8. As the movable blade 5 and the stationary blade 3 pivot relatively, the semicircular recesses 9, 10 and the round stopper 11 fitted therein also move rearward at a speed equal to that of the movement of rear cutting edge portions 29. Therefore, if a material Z is placed between the rear cutting edge portion 29 so as to contact the round stopper 11 as shown in FIG. 2, the material Z moves rearward with the round stopper 11 during the cutting operation at the same speed until the movable blade 5 is fully closed relative to the stationary blade 3 as shown in FIG. 3. The material Z is not forced onto the plate 8 during the cutting operation.

Therefore, the material 3 is cut smoothly without increasing the cutting load and damage to the cutting edges is prevented because there is no slip of the material 3 along the edges. In addition, the round stopper 11 is always held stably because the recesses 9 and 10 on the blades 3 and 5 which receive the stopper 11 are semicircular. When a material Z is placed between the front cutting edge 28, the material Z is always kept at a position apart from the plate 8 during the cutting operation and is not forced onto the plate 8.

Figure 4:
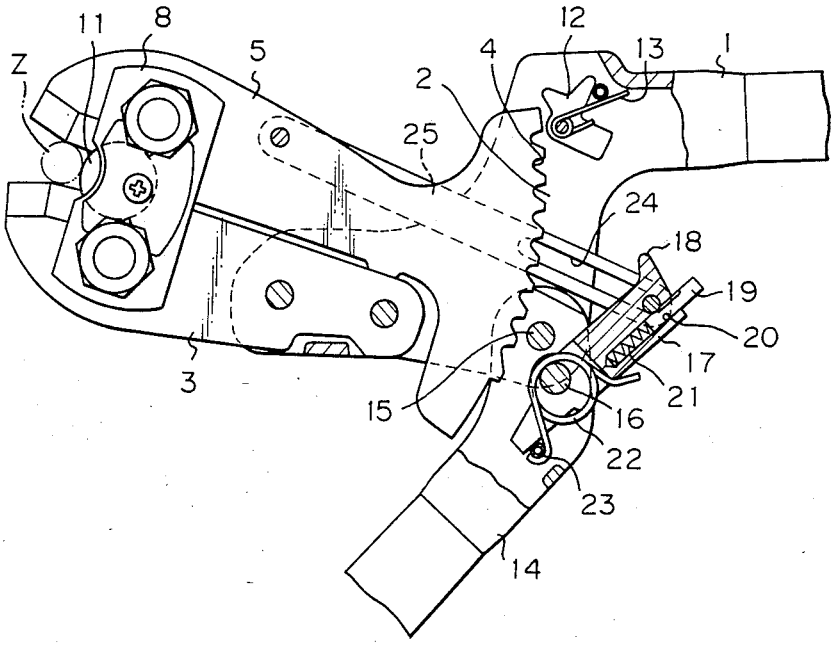
FIG. 4 and FIG. 5 are additional front views of the bolt-clipper corresponding to FIG. 1 but shown under different conditions.
Figure 5:
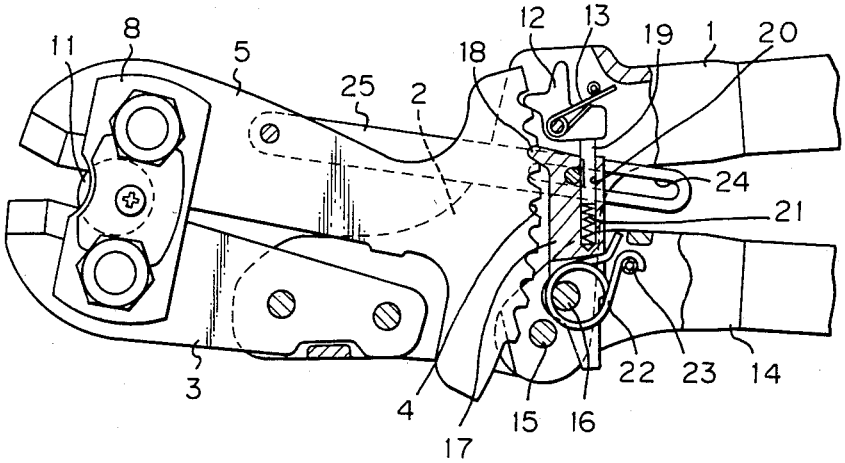
Figure 6:
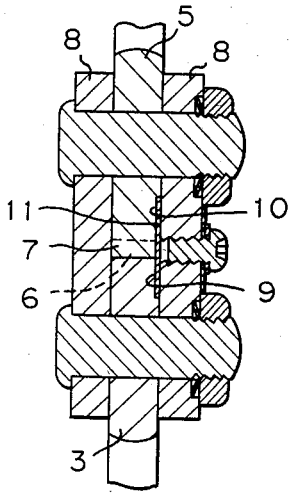
FIG. 6 is a cross sectional view of the bolt-clipper taken along the line A—A of FIG. 1.
Figure 7:
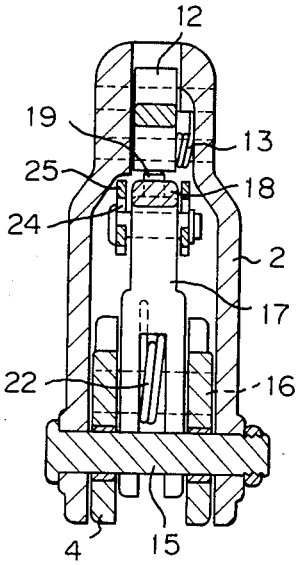
FIG. 7 is a cross sectional view of the bolt-clipper taken along the line B—B of FIG. 1.

Next, the working mechanism of a bolt-clipper according to an embodiment of the present invention is explained referring to FIGS. 1, 4 and 5.

In FIG. 1, a pawl 12 which is engageable with one of the notches 4 of the movable blade 5 is pivoted to an upper handle 1 at the center of the head portion 2. The pawl 12 is biased by a spring 13 so as to be kept in a position disengaged from any one of the notches 4 under normal conditions. A lower handle 14 is pivoted to the upper handle 1 at the lower portion of the head portion 2 by means of a pin 15. A push bar 17 is pivoted to the lower handle 14 by means of a pin 16 at a position close to the pin 15. The push bar 17 is provided with a projection 18 at its upper end for engaging with one of the notches 4 on the movable blade 5 so as to push the notches 4 up and with an elastic pin 19 for pushing the pawl 12 into an engaged position with one of the notches 4 only when the handles 1 and 14 are fully closed relative to each other. As shown in FIG. 1, the elastic pin 19 is received in a hole 20 of the push bar 17 with a spring 21. The spring 21 is stronger than the spring 13 since the spring 21 pushes the pawl 12 against the force produced by the spring 13. The push bar 17 is constantly pushed onto one of the notches 4 by a spring 22 installed around the pin 16. As shown in FIG. 4, however, the push bar 17 is rotated clockwise, being pushed by a pin 23 contacting the bottom end thereof when the lower handle 14 is fully opened relative to the upper handle. When the push bar 17 is rotated clockwise, the movable blade 5 is opened relative to the stationary blade 3 as shown in FIG. 4 since the middle portion of the movable blade 5 and the leading end of the push bar 17 are connected with each other by a link 25 with a long slit 24.

Being constructed as described above, the movable blade 5 is opened to the maximum angle relative to the stationary blade 3 when the upper handle and the lower handle 14 are fully opened relative to each other by both hands. Under this condition, a material Z is placed between the cutting edges of movable blade 5 and stationary blade 3. Then the lower handle 14 is moved gradually toward the upper handle 1. As the lower handle 14 comes closer to the upper handle 1, the pin 23 comes out of contact with the bottom end of the push bar 17, and the push bar 17 is then rotated counterclockwise by, the spring 22 until the projection 18 of the push bar 17 engages with one of the notches 4 at a relatively upper position. It should be noted that the pawl 12 is kept in a position disengaged from any one of the notches 4 at this time. When the lower handle 14 is moved further toward the upper handle 1, the projection 18 of the push bar 17 pushes the notches 4 up, pivoting the movable blade 5 counterclockwise. Thus, cutting of the material Z is then started. Since the pawl 12 is not engaged with any of the notches 4 as mentioned above, there is no contact or relative slip between the pawl 12 and the notches 4 during the pivoting of the movable blade 5. When the lower handle 14 is fully closed relative to the upper handle 1, the elastic pin 19 in the push bar 17 pushes the pawl 12 so as to bring it into a position engaged with one of the notches 4 as shown in FIG. 5. Then the lower handle 14 is returned or moved away from the upper handle 1. When the return operation of the lower handle 14 is started, the elastic pin 19 pushes the pawl 12 into the notch 4. When the lower handle 14 is returned further, the pawl 12 is forced to keep in engagement with the notch 4 firmly due to the reaction force of the blades 3 and 5 cutting into the material 3. Therefore, the movable blade 5 is kept in the same position when the lower handle 14 is being moved away from the upper handle 1. The push bar 17 moves downward along the notches 4 with the projection 18 slip-contacting the notches 4 until the projection 18 engages with one of the notches 4 at a lower position. Then the lower handle 14 is moved again toward the upper handle 1, pushing the notches 4 upward by means of the push bar 17, thus pivoting the movable blade 5 for further cutting into the material Z. As soon as the notches 4 are pushed upward, the pawl 12 comes out of contact with the notch 4 and is biased by a spring 13 to a position disengaged from the notch 4. Therefore, the pawl 12 does not make contact with the notches 4 during the movement of the movable blade 5. When the lower handle 14 is fully closed relative to the upper handle 1, the elastic pin 19 of the push bar 17 pushes the pawl 12 again to bring it into a position engaged with one of the notches 4, thus holding the movable blade 5 at a final cutting position. The above steps are repeated so that the movable blade 5 further cuts into the material Z until the movable blade 5 and the stationary blade 3 come into a full contact, with each other thus completing the cutting procedure as shown in FIG. 1. Since the cutting of a material 3 proceeds gradually as the lower handle 14 is moved away from and toward the upper handle 1 repeatedly, even a hard wire can easily be cut. In the embodiment of the present invention, the last or bottom pitch of the notches 4 is larger than the other pitches so as to prevent the engagement of the pawl 12 with one of the notches 4 when the movable blade 5 and the stationary blade 3 are in contact as shown in FIG. 1. Therefore, after the completion of cutting a material 3, the lower handle 14 can be returned or moved away from the upper handle 1 easily without the need for disengaging the pawl 12 from one of the notches 4.

As is apparent from the above descriptions, the pawl 12 is engaged with one of the notches 4 only when the lower handle 14 is being returned or moved away from the upper handle 1. This is due to the construction whereby the pawl 12, which is engageable with one of the notches 4 of the movable blade 5, is kept in a position disengaged from all of the notches 4 under normal conditions by a spring and whereby the lower handle 14 is provided with a push bar 17 having a projection 18 for pushing notches 4 up and an elastic pin 19 for forcing the pawl 12 to engage with one of the notches 4. Therefore, compared with a conventional cutting tool in which a pawl 12 is constantly kept engaged with one of the notches 4, the wear of the pawl 12 and notches 4 is reduced, which brings about a longer life of the tool. Disengagement of the pawl 12 from one of the notches 4 can be accomplished by moving the lower handle 14 toward the upper handle 1 so as to pivot the movable blade 5 slightly, since the pawl 12 is always biased by the spring 13 toward a position disengaged from the notch 4. Therefore, manual disengagement of the pawl 12 is not required, which is helpful in avoiding the danger of injury.

What is claimed is:

1. A cutting tool comprising:

a stationary blade and a movable blade positioned facing each other and both having teeth portions in mesh with each other, each of said blades having a cutting edge portion at the leading end thereof so that said cutting edge portions face each other, said movable blade having a plurality of notches along the rear end thereof, and said blades being pivoted to a common plate at points outward of said cutting edge portions;

a pair of handles pivoted toward each other so as to be opened or closed relative to each other for pivoting said movable blade relative to said stationary blade so that said cutting edge portions may be opened or closed relative to each other, one handle of said pair of handles being fixed to the rear of said stationary blade;

a pawl pivoted to said one handle of said pair of handles and engageable with one of said notches so as to prevent the return of said movable blade;

a push bar pivoted to the other handle of said pair of handles;

projection means, provided on said push bar, for pushing up one of said notches when said pair of handles are moved toward each other;

means, arranged adjacent to said pawl, for elastically biasing said pawl around a pivot axis thereof so as to keep the pawl in a position disengaged from all of said notches under normal conditions; and means, provided on said push bar, for elastically urging said pawl to engage with one of said notches by forcing said pawl to rotate against an elastically biased force producted by said elastically biasing means when said pair of handles are fully closed relative to each other;

wherein said elastically urging means, having said pawl engage with one of said notches, is an elastic pin supported by a spring in a hole provided in said push bar.

2. A cutting tool according to claim 1 wherein the means for elastically biasing said pawl around the pivot axis thereof is a rotational spring.

3. A cutting tool according to claim 1 wherein said movable blade is formed such that the last pitch of said notches is larger than the other pitches.

4. A cutting tool according to claim 1 wherein a semicircular recess is provided on each of said movable blade and stationary blade surrounding said teeth portion, both of said semicircular recesses being located on the same side and generally concentrically with each other, and a round stopper is fitted into a generally round recess formed by the combination of said semicircular recesses.

5. A cutting tool according to claim 4, wherein the position of the front end point of said round stopper coincides with that of the front end point of said plate when said cutting edge portions on said movable blade and stationary blade are in a closed position relative to each other.

6. A cutting tool according to claim 1 wherein said cutting tool is a boltclipper.

7. A cutting tool according to claim 1 wherein each of said cutting edge portions on said movable blade and stationary blade consists of a front cutting edge portion and a rear cutting edge portion, said front cutting edge portions of both of said blades having an opening angle equal to the maximum swing angle of said movable blade relative to said stationary blade and said rear cutting edge portions of both of said blades having an opening angle of less than 15°.

* * * * *